US009335090B2

(12) United States Patent
Brenneis et al.

(10) Patent No.: US 9,335,090 B2
(45) Date of Patent: May 10, 2016

(54) REFRIGERATOR

(75) Inventors: Juergen Brenneis, Pinsdorf (AT); Rainer Vogt, Bad Reichenhall (DE); Giuseppe Margarino, Moncalvo (IT); Marco Reposo, Monferrato (IT)

(73) Assignee: Red Bull GmbH, Fuschl am See (AT)

( * ) Notice: Subject to any disclaimer, the term of this patent is extended or adjusted under 35 U.S.C. 154(b) by 377 days.

(21) Appl. No.: 13/184,896

(22) Filed: Jul. 18, 2011

(65) Prior Publication Data

US 2012/0017631 A1 Jan. 26, 2012

(30) Foreign Application Priority Data

Jul. 22, 2010 (EM) ..... 001735028
Sep. 16, 2010 (AT) ..... GM581/2010 U

(51) Int. Cl.
*F25D 23/02* (2006.01)
*F25D 31/00* (2006.01)
*F25D 11/02* (2006.01)

(52) U.S. Cl.
CPC ..... *F25D 31/007* (2013.01); *F25D 11/02* (2013.01); *F25D 2331/803* (2013.01)

(58) Field of Classification Search
CPC ..... F25D 23/04; F25D 23/23; F25D 19/00; F25D 2300/006; F25D 31/007; F25D 2331/803; F25D 2331/805; F25D 2331/809; F25D 11/02; F25D 23/12; F25D 2400/10; F25D 23/123; F25D 31/002
USPC ..... 62/441, 457.4, 457.8, 448, 516, 517, 62/440, 258, 518, 519, 526, 337, 377, 331, 62/261
See application file for complete search history.

(56) References Cited

U.S. PATENT DOCUMENTS 1,789,916 A * 1/1931 Thornton, Jr. ..... 62/448
2,072,347 A * 3/1937 Strebler ..... 62/98
2,083,477 A * 6/1937 Simard ..... 62/258

(Continued)

FOREIGN PATENT DOCUMENTS

CN 100374796 A 3/2008
DE 555817 A 8/1932

(Continued)

OTHER PUBLICATIONS

International Preliminary Report on Patentability dated Mar. 19, 2013, in International Application No. PCT/EP2011/003576, filed Jul. 18, 2011, 6 pages.

(Continued)

*Primary Examiner* — Cassey D Bauer
*Assistant Examiner* — Kirstin Oswald
(74) *Attorney, Agent, or Firm* — Seed IP Law Group PLLC

(57) ABSTRACT

A refrigerator (1) comprising a thermally insulated refrigerator compartment (15), a refrigeration machine by means of which the refrigerator compartment (15) can be cooled to a temperature below ambient temperature, and at least one door (3, 4) through which the refrigerator compartment (15) can be accessed from outside is further provided with a bottle cooler (9) the interior of which is designed to accommodate at least one bottle and can be cooled to a temperature below ambient temperature and whose opening (10) for placing a bottle therein and removing a bottle is preferably arranged in the top side of the refrigerator (1).

25 Claims, 4 Drawing Sheets

(56) References Cited

U.S. PATENT DOCUMENTS

| | | | | | |
|---|---|---|---|---|---|
| 2,139,441 | A | * | 12/1938 | Clarke | 62/266 |
| 2,166,506 | A | * | 7/1939 | Philipp | 62/333 |
| 2,169,201 | A | * | 8/1939 | Very | 62/417 |
| 2,181,553 | A | * | 11/1939 | Hiller | 62/331 |
| 2,205,364 | A | * | 6/1940 | Philipp | 62/432 |
| 2,215,192 | A | * | 9/1940 | Read | 62/431 |
| 2,222,543 | A | * | 11/1940 | Schmidt | 62/287 |
| 2,273,189 | A | * | 2/1942 | Guyton | 62/224 |
| 2,319,441 | A | * | 5/1943 | Buxton | 74/7 B |
| 2,341,183 | A | | 2/1944 | Loewy | |
| 2,401,613 | A | * | 6/1946 | Charland | 62/334 |
| 2,509,404 | A | * | 5/1950 | Whitmore | 62/213 |
| 2,575,094 | A | * | 11/1951 | Chamberlain | 62/375 |
| 2,838,917 | A | | 6/1958 | Smithson | |
| 3,360,322 | A | * | 12/1967 | Hanifan | 312/312 |
| 3,605,431 | A | * | 9/1971 | Carson | 62/190 |
| 3,712,078 | A | * | 1/1973 | Maynard et al. | 62/448 |
| 3,832,862 | A | * | 9/1974 | Ingels | 62/227 |
| 4,711,099 | A | * | 12/1987 | Polan et al. | 62/457.4 |
| 5,862,672 | A | * | 1/1999 | Faries et al. | 62/68 |
| 6,094,934 | A | * | 8/2000 | Rand et al. | 62/440 |
| 6,220,049 | B1 | * | 4/2001 | Lajeunesse | 62/440 |
| 6,446,459 | B1 | * | 9/2002 | Sawhney et al. | 62/440 |
| 7,213,410 | B2 | * | 5/2007 | Lipp et al. | 62/441 |
| 2009/0044549 | A1 | * | 2/2009 | Sundhar | 62/125 |
| 2010/0018223 | A1 | * | 1/2010 | Sundhar | 62/3.63 |

FOREIGN PATENT DOCUMENTS

| | | | |
|---|---|---|---|
| EP | 2119987 | A1 | 11/2009 |
| FR | 1316433 | | 12/1962 |
| JP | S50-19784 | | 3/1975 |
| JP | S56-54343 | A | 5/1981 |
| JP | S60-35180 | U | 3/1985 |
| JP | 2000-205722 | A | 7/2000 |
| JP | 2003-501607 | A | 1/2003 |
| JP | 2004-106927 | A | 4/2004 |
| JP | 2007-064596 | A | 3/2007 |
| JP | 2009-097756 | A | 5/2009 |
| JP | 2009-168277 | A | 7/2009 |

OTHER PUBLICATIONS

Japanese Office Action mailed May 27, 2014, in Japanese Patent Application No. 2013-528527, filed Jun. 9, 2011, 4 pages.

* cited by examiner

REFRIGERATOR

BACKGROUND

The invention relates to a refrigerator comprising a thermally insulated refrigerator compartment, a refrigeration machine by means of which the refrigerator compartment can be cooled to a temperature below ambient temperature, and at least one door through which the refrigerator compartment can be accessed from outside.

Such refrigerators serve to store heat-sensitive goods or products. They are mainly used in households and the restaurant and food service industry, but also in the food-processing industry, in medicine and research. They generally consist of a thermally insulated refrigerator compartment that serves to store the relevant goods or products, and a refrigeration machine by means of which the refrigerator compartment is cooled. In principle, the refrigeration machine may have any desired mode of operation, but it will be a compression-type chiller in most cases or, less frequently, an absorption unit. All types of refrigerators are based on the following operating principle: heat is extracted from the interior of the refrigerator and transferred to the outside. Both of these actions are performed by means of heat exchangers. The typical operating temperature inside refrigerators used in households or the restaurant and food service industry ranges between 2° C. and 8° C.

Refrigerators for use in households and the restaurant and food service industry are available in different sizes. Besides refrigerators with a typical width of approx. 60 cm and a height of up to 2 m that are intended to be installed in private kitchens, comparatively, small refrigerators are mainly used in the restaurant and food services industry that may, for example, be placed on a counter so as to be well visible to the customers of the restaurant, enabling the latter to have a look at the cooled drinks and food items on offer. Such display refrigerators comprise a transparent door in most cases and are provided to the restaurants and dining establishments by the manufacturers of the drinks offered. As a rule, this is done for promotional purposes and the refrigerators are therefore provided with the trademark, the product logo, a promotional message, or the like of the manufacturer of the drinks in question. The drinks are increasingly stored in cans or bottles with a maximum content of 0.5 liters and the drinks are sold in the units defined by the content of the cans or bottles, for example.

The drinks stored in said cans or bottles are often offered in combination with other drinks in restaurants and dining establishments. For example, it is common practice to mix soft drinks and spirits to obtain mixed drinks. As a rule, the spirits are admixed in comparatively small amounts, so that one bottle of spirit is sufficient to prepare a correspondingly large number of units of the mixed drink. To achieve an optimum result, not just the cans or bottles of the soft drink but also the spirits must be kept refrigerated, which means that the bottle of spirit must be returned to the refrigerator each time a mixed drink has been prepared. As a consequence, the refrigerator must be opened and closed many times, which causes warm ambient air to flow into the refrigerator compartment of the refrigerator, so that the chiller units of smaller refrigerators used in the restaurant and food service industry will often be unable to ensure a constant low temperature inside the refrigerator due to their compact design and low refrigeration capacity.

Another drawback of conventional refrigerators, especially in the restaurant and food service industry, is that the refrigerator compartment and, in particular, the arrangement of the shelves inside the refrigerator compartment is optimized to accommodate a largest possible number of cans or bottles of the same size, which causes problems if in addition the bottle of spirit mentioned above is to be placed in such a refrigerator, for example.

While it would be possible to use separate refrigerators to store the cans or bottles of drinks and the spirits, this requires the restaurant or dining establishment to invest more in equipment on the one hand and increases the amount of labor to be done by the service staff on the other. The use of two or more separate refrigerators is also inconvenient if a supply of cans or bottles of the soft drink as well as a bottle of spirit are to be provided in a refrigerated state to people who are located in the restaurant in question but outside the bar or counter area, e.g., in a VIP area of the restaurant, at a table, on a stage, or at a mixing desk or the like. The same is true for private homes or private events.

SUMMARY AND INITIAL DESCRIPTION

An object of the present application is therefore to provide a refrigeration unit that is able to eliminate the drawbacks mentioned above. In particular, in addition to refrigerating smaller units of food and/or drink, the refrigerator should at the same time provide the option to cool at least one bottle of a drink that can be easily accessed by the service staff or the consumer without adversely affecting refrigeration of the other drinks or food items. The refrigerator should be as small as possible, so that it can be placed on a bar or a counter if required. In addition, the refrigerator should be easy to transport.

To achieve this object, a basic idea of the invention is that a refrigerator of the type mentioned in the opening paragraph comprises a bottle cooler the interior of which is designed to accommodate at least one bottle and can be cooled to a temperature below ambient temperature and whose opening for placing a bottle therein and removing a bottle is preferably arranged in the top side of the refrigerator. If such a dedicated bottle cooler is provided, a further refrigeration unit is created that is additional to the usually rectangular refrigerator compartment and is specifically optimized to accommodate bottles. An essential feature of the bottle cooler is that it can be accessed through its own opening that is separate from the access to the refrigerator compartment, so that the door of the refrigerator compartment need not be opened in order to remove or return a bottle. In this way, a bottle of spirit, for example, can be accessed quickly and directly without the risk that the refrigerator compartment will warm up even if the bottle is removed and returned many times. The fact that the interior of the preferably cylindrical bottle cooler can be accessed from above ensures easy access on the one hand and a locking mechanism of the access opening can preferably be eliminated on the other as the cold air will remain inside the bottle cooler even without a locking mechanism due to its higher specific weight.

The refrigerator is preferably designed as an easy-to-transport, free-standing device. It is preferred that the maximum outside dimensions be 50×50×80 cm (width×depth×height).

The bottle cooler according to the invention can be cooled to a temperature below ambient temperature, wherein active refrigeration by means of a refrigeration machine is preferred. In particular, the bottle cooler can be cooled to a temperature below ambient temperature by means of the same refrigeration machine that also cools the refrigerator compartment.

A particular challenge with regard to the refrigerator of the invention is to arrange the bottle cooler in such a manner that the refrigerator compartment will not become smaller due to the bottle cooler on the one hand while the overall size of the refrigerator will not be significantly increased on the other. According to a preferred configuration of the refrigerator according to the invention in this context, a chamber is arranged above the refrigerator compartment, in which chamber the essential components of the refrigeration machine, such as, in particular, a compression element, are arranged and into which the bottle cooler extends from above. Said chamber is preferably the enclosed space above the refrigerator compartment whose bottom surface area substantially corresponds to the bottom surface area of the refrigerator. The chamber that is created due to the necessary size of the bottle cooler is thus used to arrange at least some of the technical components that are required for the operation of the refrigeration machine. The components of the refrigeration machine are therefore arranged above the refrigerator compartment, thus maximizing the bottom surface area of the refrigerator compartment to make optimal use of the available space as a result. As the most important technical components of the refrigeration machine, such as, in particular, a compression element, are arranged in the chamber above the refrigerator compartment rather than on the rear side of the refrigerator, there is the advantage that two doors may be provided on opposite sides of the refrigerator through each of which the refrigerator compartment can be accessed from outside. On the one hand, this provides more convenience to the user, in particular, if the refrigerator is placed at a distance from other units, walls, etc., since the cooled drinks and/or food items are accessible from two sides. On the other hand, it reduces installation work if one door is designed to open/close on the left-hand side and the other door is designed to open/close on the right-hand side, as is preferred. To change the side where the door opens/closes, the refrigerator must be turned by 180° and placed or installed in the turned-around position.

The design and/or operating principle of the refrigeration machine can in principle be freely selected in the context of the invention. Preferably, the refrigeration machine comprises a first heat exchanger to absorb heat below ambient temperature and a second heat exchanger to release heat above ambient temperature in order to perform a cyclic process. The refrigeration machine can, for example, be designed as a compression-type chiller where a compression element and an expansion element as well as the first and second heat exchangers are interconnected in a cycle in such a manner that the heat exchangers are connected between the compression element and the expansion element on both sides. To maximize the surface area that is available for heat transfer in each case while the space required is the same, the first heat exchanger comprises a meandering pipe, in particular, an evaporator having at least one evaporator coil, and the second heat exchanger comprises a meandering pipe, in particular, a condenser having at least one condensing coil, in a preferred configuration.

The bottle cooler can be cooled particularly efficiently if the at least one pipe of the first heat exchanger, in particular, the evaporator coil, is wound around the bottle cooler, in accordance with a preferred configuration. To cool both the refrigerator compartment and the bottle cooler in a simple manner, a first section of the pipe of the first heat exchanger may be thermally coupled to the refrigerator compartment and a second section of the pipe of the first heat exchanger may be thermally coupled to the bottle cooler, in particular, wound around the latter.

To provide sufficient thermal insulation of the refrigerator compartment in a simple manner, it is preferred that the refrigerator compartment be delimited by a lower inner wall element, at least two lateral inner wall elements and an upper wall element, that at least one of the inner wall elements has a corresponding outer wall element which is arranged at a distance from the inner wall element, and that a thermal insulation is arranged between the inner wall element and the corresponding outer wall element. As a result, at least one wall of the refrigerator compartment is designed to be double-walled. A section of the pipe of the first heat exchanger can be arranged between the inner and outer wall elements in a simple manner. According to an advantageous configuration, a meandering section of the pipe of the first heat exchanger is thermally coupled to the outside of the lateral inner wall elements and optionally of the lower inner wall element and, in particular, is in direct contact therewith in order to provide a good heat transfer between the refrigerator compartment and the first heat exchanger. The aforesaid thermal insulation should naturally be arranged on the side of the pipe of the first heat exchanger which faces away from the refrigerator compartment. The pipe of the first heat exchanger can naturally also be arranged inside the refrigerator compartment.

The refrigeration capacity of the refrigerator depends not just on a proper insulation of the refrigerator compartment but is also largely dependent on the amount of heat which is released to the environment by the second heat exchanger since this amount of heat determines the amount of heat that can be extracted from the refrigerator compartment and/or the bottle cooler. It must thus be ensured that the second heat exchanger comprises a sufficiently large surface area for heat exchange with the environment.

According to a preferred configuration in this context, a meandering section of the pipe of the second heat exchanger is arranged in the chamber and interacts with means for improving or accelerating heat transfer to the environment. The means for improving and/or accelerating heat transfer may, for example, comprise a fin structure or grid structure that is thermally coupled to the pipe of the second heat exchanger and, in particular, is in direct contact therewith. As an alternative or in addition, the means for accelerating heat transfer may comprise an electric fan which is arranged near the pipe of the second heat exchanger.

To further increase the surface area of the second heat exchanger that can be used for heat exchange with the environment without increasing the size of the refrigerator, it is preferred that a section, in particular, a meandering section, of the pipe of the second heat exchanger extends on the inner side of an outer wall element, preferably of the lateral outer wall elements and of the lower outer wall element. In this way, the additional amount of cold required by the bottle cooler can be provided in a simple manner.

DESCRIPTION OF THE DRAWINGS

The invention will now be explained in more detail with reference to an exemplary embodiment which is diagrammatically shown in the drawing.

DETAILED DESCRIPTION

Figure 1:
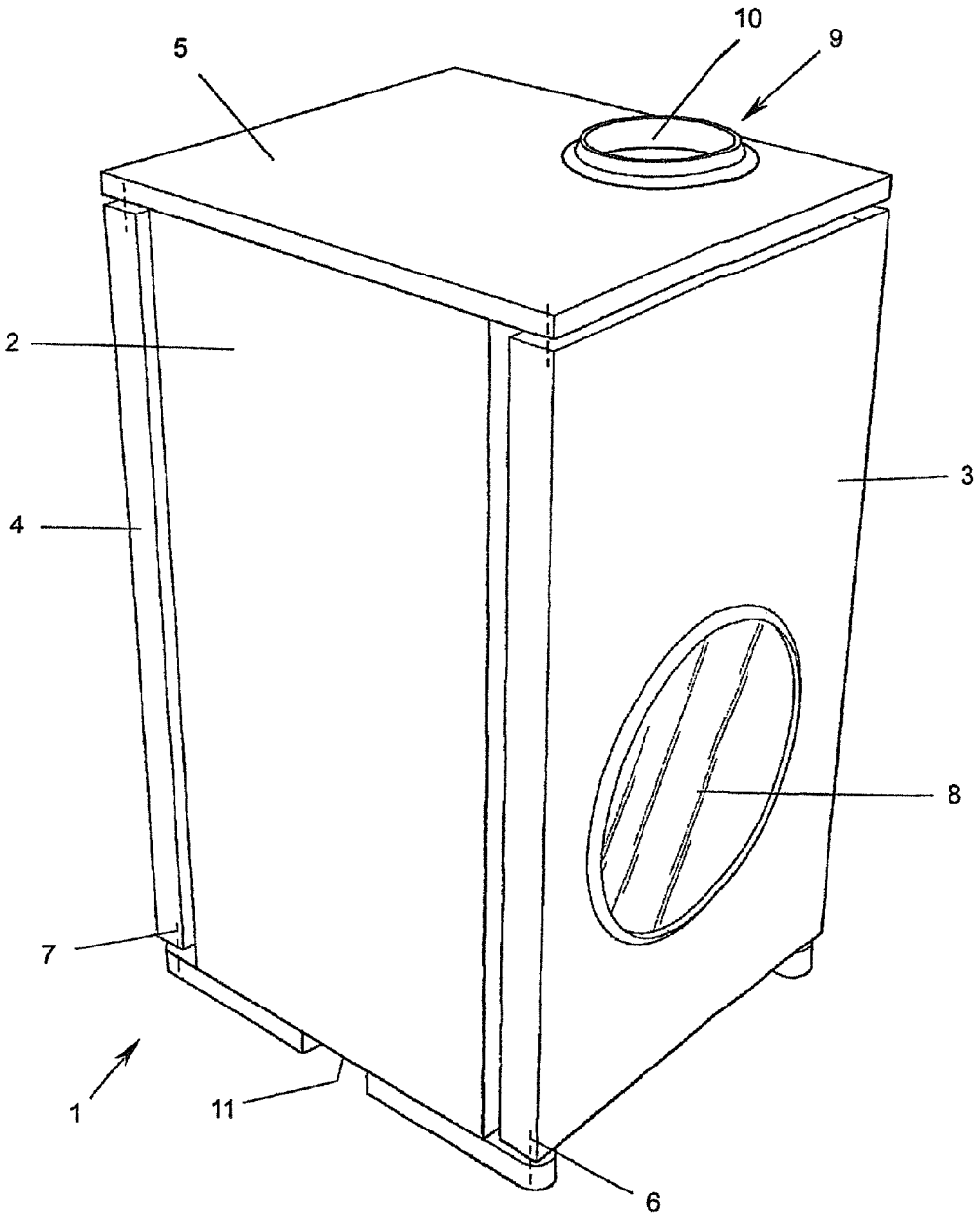
FIG. 1 shows a perspective view of the refrigerator.

FIG. 1 shows a refrigerator 1 which is intended for use in the restaurant and food service industry and comprises two side walls 2, of which only one is shown in FIG. 1, a door 3 which is arranged on the front side, and a door 4 arranged on the rear side. The refrigerator 1 comprises a cover plate 5 on the top side. The hinge for opening the front door 3 is marked with 6 and the hinge for opening the rear door 4 is marked with 7. The hinges 6 and 7 are arranged in such a manner that the front door 3 is designed to open/close on the left-hand side and the rear door 4 is designed to open/close on the right-hand side. Both the front door 3 and the rear door 4 comprise a window 8 through which one can look into the refrigerator compartment. The refrigerator compartment can be accessed from outside through the doors 3 and 4. In the upper area of the refrigerator 1, a bottle cooler 9 is provided, the opening 10 of which is arranged in the top side of the refrigerator 1. In the present exemplary embodiment, the bottle cooler is designed to be cylindrical and is dimensioned to accommodate a 1 liter bottle in an upright position. While the opening 10 might be closed by a separate lid, the bottle cooler 9 is designed to be open at the top in the present exemplary embodiment, so that the bottle cooler does not define a limit for the height of the bottle. If the bottle cooler is dimensioned such that, depending on the kind of bottle, at least the bottleneck projects beyond the cooler, the bottle can be removed from the bottle cooler and returned to the bottle cooler particularly easily and quickly. While it may be conceived that the interior of the bottle cooler, which is, in particular, cylindrical, is open towards the refrigerator compartment, which is arranged below and is, in particular, rectangular, it is preferred that the bottle cooler provides a separate refrigeration volume which is closed off from the refrigerator compartment.

Figure 2:
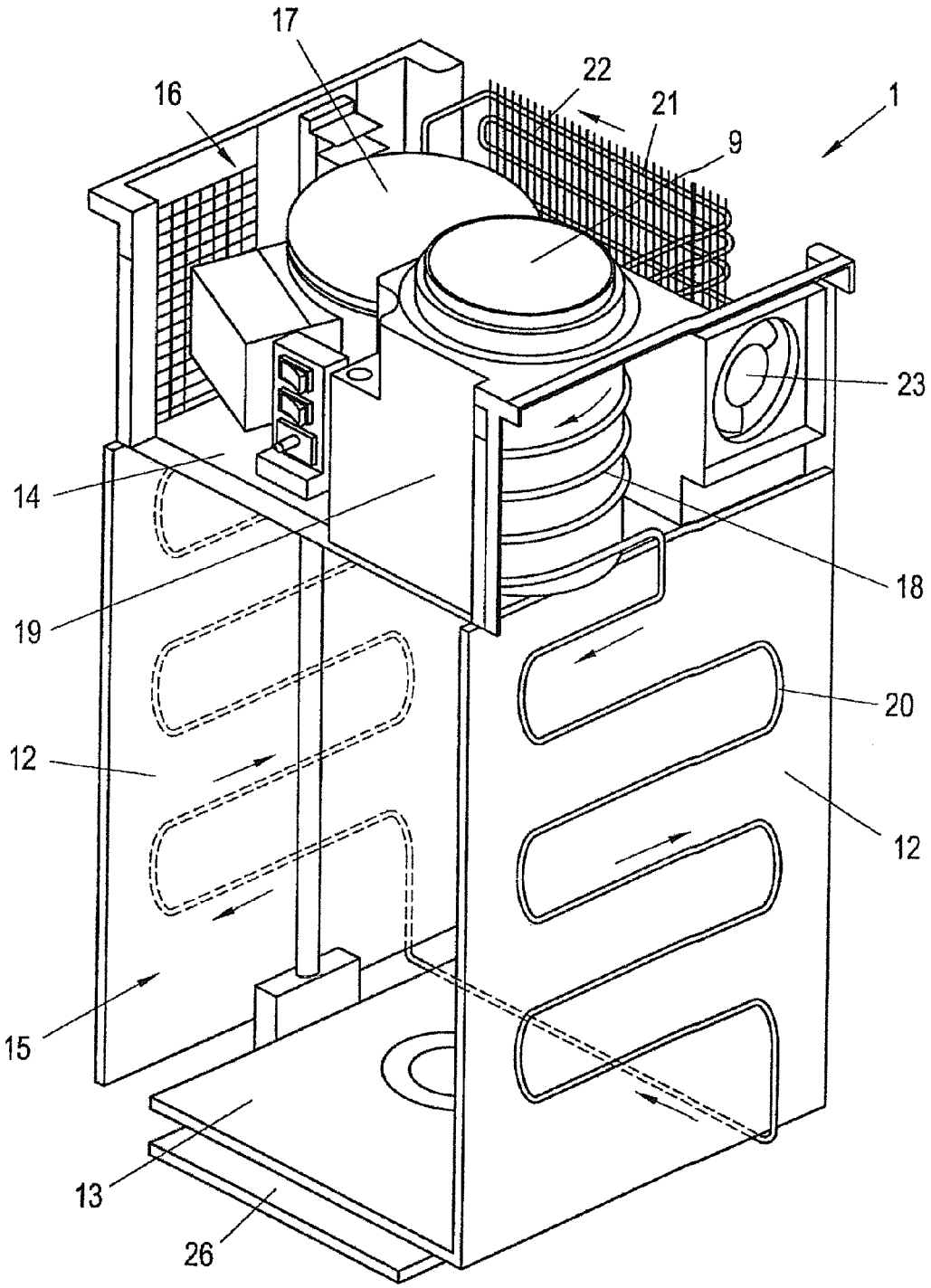
FIG. 2 is an illustration where the housing has been removed.
Figure 3:
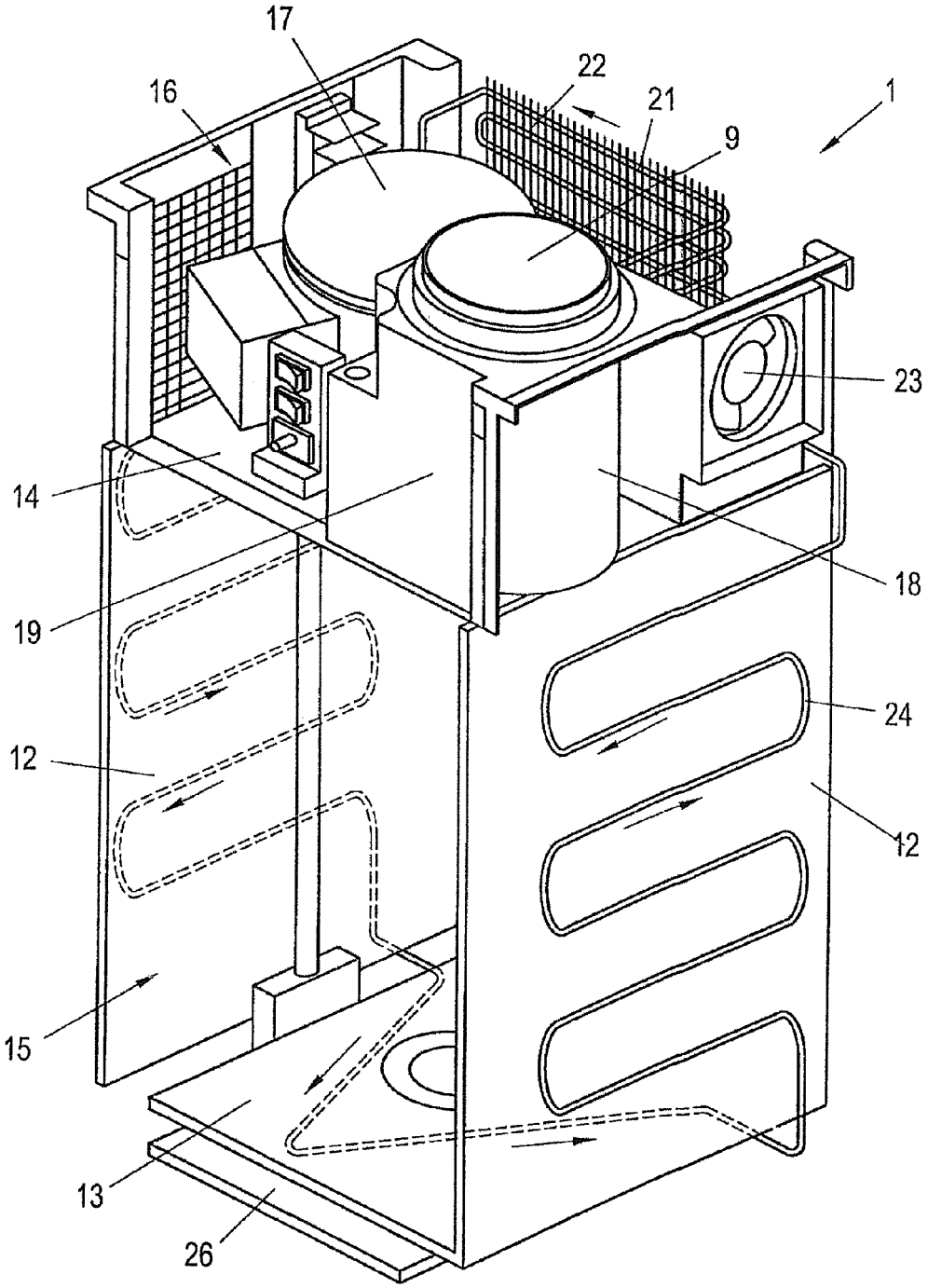
FIG. 3 is another illustration where the housing has been removed.

The side walls 2 and the lower wall 11 are designed as double-walled elements and each consist of an inner wall element and an outer wall element. FIGS. 2 and 3 show the refrigerator without the lateral outer wall elements, without the doors 3 and 4 and without the cover plate 5, wherein for the sake of clarity FIG. 2 only shows the evaporator coil and FIG. 3 only shows the condensing coil.

It can be seen that a refrigerator compartment 15 is delimited by two lateral inner wall elements 12, a lower inner wall element 13, and an upper wall element 14. A chamber 16 is provided above the refrigerator compartment 15, in which chamber technical components of the refrigeration machine as well as the bottle cooler 9 are arranged. The chamber 16 is separated from the refrigerator compartment by the wall element 14. The refrigeration machine is designed as a compression-type chiller where a compression element and an expansion element as well as a first and a second heat exchanger are interconnected in a cycle in such a manner that the heat exchangers are connected between the compression element and the expansion element on both sides. The compression element is designed as a compressor 17. The first heat exchanger comprises an evaporator coil that is wound around the bottle cooler 9 in a first section 18, thus cooling said bottle cooler. The bottle cooler 9 comprises a thermally insulated jacket 19 that reduces heat transfer from outside, for example, from the compressor 17 to the bottle cooler 9 and the evaporator coil 18. In a second adjacent section 20 (FIG. 2), the evaporator coil of the first heat exchanger follows a meandering path and forms a refrigerating coil which is affixed to the lateral inner wall elements 12 and to the lower inner wall element 13, thus cooling the refrigerator compartment 15. The two sections of the evaporator coil 20 that extend on the lateral inner wall elements 12 are connected to each other by a section extending on the lower inner wall element 13.

The expansion element of the compression-type chiller is designed as a throttle, e.g., as an expansion valve or a capillary tube. The second heat exchanger comprises a condensing coil, a first section 21 of which follows a meandering path and is arranged in the chamber 16. To improve heat transfer to the environment, the condensing coil 21 is affixed to a fin structure or grid structure 22. In addition, an electric fan 23 is provided near the condensing coil 21 in the chamber 16, which electric fan further improves heat transfer to the environment. A second section 24 (FIG. 3) of the condensing coil of the second heat exchanger follows a meandering path on the inside of the lateral outer wall elements 25 and of the lower outer wall element 26. The two sections of the condensing coil 24 that extend on the lateral outer wall elements 25 are connected to each other by a section extending on the lower outer wall element 26.

Figure 4:
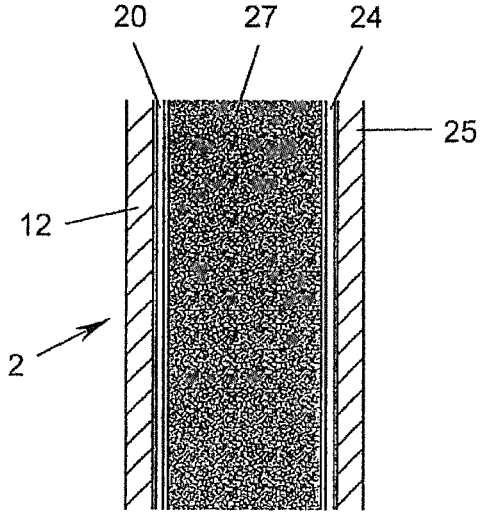
FIG. 4 shows a detailed view of a housing wall.

In the sectional view according to FIG. 4, it can be seen that a thermal insulation 27 is arranged between the lateral inner wall element 12 and the lateral outer wall element 25 of the side wall 2, which insulation is, for example, made of a mineral wool or of foam (e.g., styrofoam or the like). The lower wall 11 has a similar structure.

The operating principle of the compression-type chiller is as follows: a gaseous refrigerant is compressed adiabatically, i.e., without heat exchange with the environment, by the compressor 17, thus warming up the refrigerant. The heat is released to the environment in the second heat exchanger, i.e., the condenser comprising the condensing coil 21, 24, so that the fluid will condense. The fluid is then passed through a throttle to reduce pressure and flows on into the first heat exchanger, i.e., the evaporator comprising the evaporator coil 18, 20. Here, the evaporating refrigerant extracts the amount of heat required for evaporation from the refrigerator compartment 15 and/or the bottle cooler 9 and flows on to the compressor 17 as a gas.

The embodiments of the invention in which an exclusive property or privilege is claimed are defined as followed:

1. A refrigerator, comprising:

a thermally insulated refrigerator compartment;

a refrigeration machine configured to cool the refrigerator compartment to a temperature below ambient temperature;

at least one door through which the refrigerator compartment can be accessed from outside;

a bottle cooler having an interior designed to accommodate at least one bottle and be cooled to a temperature below ambient temperature, wherein the bottle cooler has an opening arranged on a top side of the refrigerator, separate from the at least one door for placing a bottle therein and removing a bottle from the bottle cooler, and wherein the at least one door through which the refrigerator compartment can be accessed need not be opened in order to place a bottle in or remove a bottle from the bottle cooler; and a chamber arranged above the refrigerator compartment, wherein a compressor and components of the refrigeration machine are arranged in the chamber, and wherein the bottle cooler extends downward from the opening into the chamber above the refrigerator compartment from the top side of the refrigerator.

2. The refrigerator according to claim 1, wherein the bottle cooler is cylindrical.

3. The refrigerator according to claim 1, wherein the refrigeration machine comprises a first heat exchanger to absorb heat below ambient temperature and a second heat exchanger to release heat above ambient temperature in order to perform a cyclic process.

4. The refrigerator according to claim 3, wherein the refrigeration machine is a compression-type chiller having a compressor and an expansion element, and wherein the first and second heat exchangers are interconnected in a cycle such that the heat exchangers are connected between the compressor and the expansion element.

5. The refrigerator according to claim 3, wherein the first heat exchanger comprises a meandering pipe that forms an evaporator having at least one evaporator coil, and the second heat exchanger comprises a meandering pipe that forms a condenser having at least one condensing coil.

6. The refrigerator according to claim 5, wherein the meandering pipe of the first heat exchanger is wound around the bottle cooler.

7. The refrigerator according to claim 6, wherein the refrigerator compartment is delimited by a lower inner wall element, at least two lateral inner wall elements and an upper wall element, wherein at least one of the inner wall elements has a corresponding outer wall element arranged at a distance from the inner wall element, and wherein a thermal insulation is arranged between the inner wall element and the corresponding outer wall element.

8. The refrigerator according to claim 7, wherein a section of the meandering pipe of the first heat exchanger is thermally coupled to an outside of the at least two lateral inner wall elements.

9. The refrigerator according to claim 8, wherein the section of the meandering pipe of the first heat exchanger is in direct contact with the outside of the at least two lateral inner wall elements.

10. The refrigerator according to claim 8, wherein the section of the meandering pipe of the first heat exchanger is further thermally coupled to an outside of the lower inner wall element.

11. The refrigerator according to claim 7, wherein a section of the meandering pipe of the second heat exchanger is arranged in a chamber above the refrigerator compartment and interacts with a heat transfer element that improves or accelerates heat transfer to a surrounding environment.

12. The refrigerator according to claim 11, wherein the heat transfer element comprises a fin structure or grid structure that is thermally coupled to the meandering pipe of the second heat exchanger.

13. The refrigerator according to claim 12, wherein the fin structure or grid structure is in direct contact with the meandering pipe of the second heat exchanger.

14. The refrigerator according to claim 11, wherein the heat transfer element comprises an electric fan that is arranged near the meandering pipe of the second heat exchanger.

15. The refrigerator according to claim 11, wherein a section of the meandering pipe of the second heat exchanger extends on an inner side of the outer wall element.

16. The refrigerator according to claim 15, wherein the section of the meandering pipe of the second heat exchanger extends on the inner side of the outer wall elements corresponding to the at least two lateral inner wall elements and the lower inner wall element.

17. The refrigerator according to claim 1, wherein two doors are provided on opposite sides of the refrigerator through each of which the refrigerator compartment can be accessed from outside.

18. The refrigerator according to claim 1, wherein the chamber is arranged vertically above the refrigerator compartment.

19. The refrigerator according to claim 1, wherein the refrigerator has a maximum height of 80 cm.

20. The refrigerator according to claim 1, wherein the bottle cooler is cooled to a temperature below ambient temperature by means of the same refrigeration machine that also cools the refrigerator compartment.

21. The refrigerator according to claim 20, wherein the refrigeration machine comprises a first heat exchanger to absorb heat below ambient temperature and a second heat exchanger to release heat above ambient temperature in order to perform a cyclic process, wherein the first heat exchanger comprises a meandering pipe that forms an evaporator having at least one evaporator coil, and the second heat exchanger comprises a meandering pipe that forms a condenser having at least one condensing coil, and wherein a first section of the pipe of the first heat exchanger is thermally coupled to the refrigerator compartment and a second section of the pipe of the first heat exchanger is thermally coupled to the bottle cooler.

22. The refrigerator according to claim 21, wherein the second section of the pipe of the first heat exchanger is wound around the bottle cooler.

23. A refrigerator, comprising:

a housing having a top side, a bottom side, and sidewalls extending between the top side and the bottom side;

a thermally insulated refrigerator compartment within the housing;

a refrigeration machine within the housing, wherein the refrigeration machine is configured to cool the refrigerator compartment to a temperature below ambient temperature;

at least one door through which the refrigerator compartment can be accessed from outside the housing;

a bottle cooler having an interior designed to accommodate at least one bottle and be cooled to a temperature below ambient temperature, wherein the bottle cooler has an opening defined in the top side of the refrigerator, separate from the at least one door for placing a bottle therein and removing a bottle from the bottle cooler, and wherein the at least one door through which the refrigerator compartment can be accessed need not be opened in order to place a bottle in or remove a bottle from the bottle cooler; and a chamber within the housing arranged above the refrigerator compartment, wherein a compressor and components of the refrigeration machine are arranged in the chamber, and wherein the bottle cooler extends into the chamber above the refrigerator compartment from the opening in the top side of the refrigerator, wherein the maximum height of the refrigerator is 80 cm.

24. A refrigerator, comprising:

a thermally insulated refrigerator compartment;

a refrigeration machine configured to cool the refrigerator compartment to a temperature below ambient temperature;

at least one door through which the refrigerator compartment can be accessed from outside;

a bottle cooler having an interior designed to accommodate at least one bottle and be cooled to a temperature below ambient temperature, wherein the bottle cooler has an opening separate from the at least one door for placing a bottle in the bottle cooler and removing a bottle therefrom, and wherein the at least one door through which the refrigerator compartment can be accessed need not be opened in order to place a bottle in or remove a bottle from the bottle cooler; and a chamber arranged above the refrigerator compartment, wherein a compressor and components of the refrigeration machine are arranged in the chamber, and wherein the bottle cooler extends downward from the opening into the chamber above the refrigerator compartment.

25. A refrigerator, comprising:

a thermally insulated refrigerator compartment;

a refrigeration machine configured to cool the refrigerator compartment to a temperature below ambient temperature;

at least one door through which the refrigerator compartment can be accessed from outside;

a bottle cooler having an interior designed to accommodate at least one bottle and be cooled to a temperature below ambient temperature, wherein the bottle cooler has an opening separate from the at least one door for placing a bottle into the bottle cooler and removing a bottle therefrom, and wherein the at least one door through which the refrigerator compartment can be accessed need not be opened in order to place a bottle in or remove a bottle from the bottle cooler; and a chamber arranged above the refrigerator compartment, wherein a compressor and components of the refrigeration machine are arranged in the chamber above the refrigerator compartment, and wherein the bottle cooler extends into the chamber from the opening, wherein the opening of the bottle cooler is not covered by a door but is open to the environment around the refrigerator.

* * * * *